US009078535B1

(12) United States Patent
Buck

(10) Patent No.: US 9,078,535 B1
(45) Date of Patent: Jul. 14, 2015

(54) CONTAINER LID WITH A FOOD COMPARTMENT AND A SIP-HOLE

(71) Applicant: Ronald Mark Buck, Encinitas, CA (US)

(72) Inventor: Ronald Mark Buck, Encinitas, CA (US)

(73) Assignee: Top-That! LLC, Encinitas, CA (US)

( * ) Notice: Subject to any disclaimer, the term of this patent is extended or adjusted under 35 U.S.C. 154(b) by 0 days.

(21) Appl. No.: 14/274,576

(22) Filed: May 9, 2014

(51) Int. Cl.
*A47G 19/22* (2006.01)
*B65D 51/28* (2006.01)

(52) U.S. Cl.
CPC ..... *A47G 19/2205* (2013.01); *B65D 51/28* (2013.01)

(58) Field of Classification Search
CPC . A47G 19/2205; B65D 51/28; B65D 21/0238
USPC ..... 206/507, 509, 514, 515; 220/23.83, 220/521, 834, 526, 709, 707, 254.1
See application file for complete search history.

(56) References Cited

U.S. PATENT DOCUMENTS

| | | | | |
|---|---|---|---|---|
| 34,976 | A | 4/1862 | Nicholson | |
| 36,131 | A | 8/1862 | Zettle | |
| 370,141 | A * | 9/1887 | Hobbs | 210/244 |
| 602,791 | A | 4/1898 | Wurzburg | |
| 674,305 | A | 5/1901 | Patterson | |
| 681,871 | A | 9/1901 | Burdick | |
| 726,321 | A | 4/1903 | Mason | |
| 730,903 | A | 6/1903 | Gibson | |
| 824,341 | A | 6/1906 | Cordes | |
| 873,867 | A | 12/1907 | Kirkgaard | |
| 930,938 | A | 8/1909 | Clement | |
| 1,002,963 | A | 9/1911 | Bostwick | |
| 1,331,336 | A | 2/1920 | Fisher | |
| 1,395,594 | A | 11/1921 | Pfefferle | |
| 1,434,831 | A | 11/1922 | Long | |
| 1,441,742 | A | 1/1923 | O'Brien | |
| 1,482,931 | A | 2/1924 | Keehn | |
| 1,485,136 | A | 2/1924 | House | |

(Continued)

FOREIGN PATENT DOCUMENTS

| | | |
|---|---|---|
| AU | 2009202213 | 5/2009 |
| AU | 2009250333 | 11/2009 |

(Continued)

OTHER PUBLICATIONS

Internationa Search Report and Written Opinion issued in PCT/US2012/054032 on Mar. 19, 2013.

(Continued)

*Primary Examiner* — Fenn Mathew
*Assistant Examiner* — Chetan Chandra
(74) *Attorney, Agent, or Firm* — Manuel de la Cerra

(57) ABSTRACT

A container lid with a food compartment is provided. The lid may be constructed in three parts: an outer food container shell, an inner food container shell and a food compartment cover. The outer food container shell is constructed to fit tightly on a beverage container and has at least one beverage transfer hole that allows the beverage to travel into the outer food container shell. When the inner food container shell is nested into the outer food container shell, a beverage conduit is formed that allows the beverage to travel from the beverage container, through the at least one beverage transfer hole, into the beverage conduit and to a sip hole. Thermoforming may be used to create each of the three parts, and the parts may snap-fit together. Different materials may be used for the parts including black opaque plastic, white opaque plastic and clear plastic.

18 Claims, 9 Drawing Sheets

(56) References Cited

U.S. PATENT DOCUMENTS 1,545,227 A 7/1925 Baltzley
1,600,758 A 9/1926 Goldstein
1,609,453 A 12/1926 Atwood
1,665,289 A 4/1928 Weaver
1,713,676 A 5/1929 Rose
1,755,042 A 4/1930 Zoller
1,773,972 A 8/1930 Eberhart
1,862,620 A 6/1932 Graham
1,948,920 A 2/1934 Johnson
1,965,713 A 7/1934 Shaw
1,985,181 A 12/1934 Matthews
1,985,258 A 12/1934 Mauser
1,985,998 A 1/1935 Koch et al.
2,003,657 A 6/1935 Stabblefield
2,015,028 A 9/1935 Gillette
2,045,480 A 6/1936 Magnesen et al.
2,050,487 A 8/1936 Durrant
2,120,403 A 6/1938 Godfrey
2,121,843 A 6/1938 Vaughn
2,142,590 A 1/1939 Smith
2,148,468 A 2/1939 Hothersall
2,174,618 A 10/1939 Burdick
2,191,705 A 2/1940 Chamberlain
2,205,685 A 6/1940 Conner
2,241,044 A 5/1941 Knut
2,271,589 A 2/1942 Hendrickson
2,276,678 A 3/1942 Wheeler
2,327,077 A 8/1943 Teetor
2,328,543 A 9/1943 Bauman
2,339,343 A 1/1944 Magnesen
2,374,092 A 4/1945 Glaser
2,375,643 A 5/1945 Sermanotta
2,421,356 A 5/1947 Saffady
2,461,908 A 2/1949 Magnesen
2,484,039 A 10/1949 Krueger
2,545,979 A 3/1951 Tregear
2,649,984 A 8/1953 Abt
2,665,023 A 1/1954 Migneault
2,671,572 A 3/1954 Staz
2,748,976 A 6/1956 Magnesen
2,753,050 A 7/1956 Langston
2,760,674 A 8/1956 Karp
2,766,796 A 10/1956 Tupper
2,816,687 A 12/1957 Phillips
2,920,804 A 1/1960 Minton
2,965,496 A 12/1960 Serdar
2,977,019 A 3/1961 Henchert
2,982,440 A 5/1961 Harrison
3,045,859 A 7/1962 McMahon
3,045,887 A 7/1962 Caine
3,064,800 A 11/1962 Hart
3,070,275 A 12/1962 Bostrom
3,071,281 A 1/1963 Sawai
3,085,710 A 4/1963 McIlroy
3,138,432 A 6/1964 Kleinhans
RE25,618 E 7/1964 Goodman
3,157,335 A 11/1964 Maier
3,163,308 A 12/1964 Friedell
3,170,591 A 2/1965 Ullman et al.
3,185,341 A 5/1965 Barbour
3,187,919 A 6/1965 Inglis
3,194,468 A 7/1965 Baron
3,244,420 A 4/1966 Poynter
3,245,691 A 4/1966 Gorman
3,269,734 A 8/1966 Ottofy
3,285,462 A 11/1966 Bulmer et al.
3,288,344 A * 11/1966 Woollen et al. ..... 229/103.1
3,323,706 A 6/1967 Gereke
3,325,048 A 6/1967 Edwards
3,327,895 A 6/1967 Mueller
3,349,941 A 10/1967 Wanderer
3,369,687 A 2/1968 Walls
3,384,265 A 5/1968 Frank
3,397,867 A 8/1968 Hoff
3,401,825 A 9/1968 Weiss
3,413,128 A 11/1968 Steinbarth et al.
3,420,399 A 1/1969 Heisler
3,421,653 A 1/1969 Whaley
3,421,654 A 1/1969 Gunter
3,421,681 A 1/1969 Frank
3,425,580 A 2/1969 Brockhage
3,433,378 A 3/1969 Ross
3,439,841 A 4/1969 Irving
3,447,710 A 6/1969 Blair
3,456,860 A 7/1969 Janninck
3,495,733 A 2/1970 Davis
3,514,029 A 5/1970 Powell
3,515,306 A 6/1970 Roper et al.
3,532,244 A 10/1970 Yates, Jr.
3,557,995 A 1/1971 Mirasol, Jr. et al.
3,561,668 A 2/1971 Bergstrom
3,580,468 A 5/1971 McDevitt
3,598,271 A 8/1971 Holley
3,603,473 A 9/1971 Winberg
3,606,262 A 9/1971 Hoff
3,616,897 A 11/1971 Vrana
3,616,955 A 11/1971 Heffran
3,624,787 A 11/1971 Newman
3,674,512 A 7/1972 Andros
3,679,089 A 7/1972 Swett et al.
3,696,987 A 10/1972 Schuff
D226,063 S 1/1973 Warnberg
3,734,276 A 5/1973 Bank
3,743,520 A 7/1973 Croner
3,745,055 A 7/1973 Gorman
3,746,158 A 7/1973 Connick
3,765,559 A 10/1973 Sauey
3,768,688 A 10/1973 Linke
3,769,056 A 10/1973 Sincock
3,770,156 A 11/1973 Yates, Jr.
3,774,797 A 11/1973 Vlilet
3,784,052 A 1/1974 Edwards
3,792,893 A 2/1974 Grotnes
3,796,813 A 3/1974 Kurland
3,797,696 A 3/1974 Dibrell
3,806,023 A 4/1974 Barnett
3,815,281 A 6/1974 Kander
3,817,419 A 6/1974 Moller et al.
3,820,684 A 6/1974 Harrison
3,822,030 A 7/1974 Tanzer
3,858,756 A 1/1975 Fulton
3,868,043 A 2/1975 Freemyer
3,874,554 A 4/1975 Chang
3,877,581 A 4/1975 Auxer
3,880,288 A 4/1975 Hunter
3,910,414 A 10/1975 McCay
3,935,318 A * 1/1976 Mihailide ..... 426/80
3,942,679 A 3/1976 Starr
RE28,797 E 5/1976 Brewer
3,963,140 A 6/1976 Harding
3,974,931 A 8/1976 Moller
4,003,488 A 1/1977 Moller
4,007,936 A 2/1977 Hornsby, Jr.
4,009,805 A 3/1977 Klygis et al.
4,018,355 A 4/1977 Ando
4,027,779 A 6/1977 De Long
4,036,392 A 7/1977 Martin
4,049,122 A 9/1977 Maxwell
4,054,205 A 10/1977 Blow, Jr. et al.
4,056,210 A 11/1977 Boyle
4,074,827 A * 2/1978 Labe, III ..... 220/522
4,091,953 A 5/1978 Daenen
4,106,660 A 8/1978 Boyle
4,119,239 A 10/1978 Anderson
4,141,462 A 2/1979 Rucci
4,146,157 A 3/1979 Dixon et al.
4,183,444 A 1/1980 English
4,183,446 A 1/1980 Davis
4,186,842 A 2/1980 Albert
4,206,845 A 6/1980 Christian
4,234,100 A 11/1980 Chabot
4,264,007 A 4/1981 Hunt
4,279,353 A 7/1981 Honma
4,318,500 A 3/1982 Melikian

(56) References Cited

U.S. PATENT DOCUMENTS 4,340,138 A 7/1982 Bernhardt
4,342,393 A * 8/1982 Box ..... 206/504
4,350,260 A 9/1982 Prueher
4,380,307 A 4/1983 Stillinger
4,389,802 A 6/1983 McLaren et al.
4,390,113 A 6/1983 Bird
4,407,426 A 10/1983 McLaren et al.
4,423,822 A 1/1984 Powalowski
4,438,865 A 3/1984 Scattaregia
4,441,623 A 4/1984 Antoniak
4,446,969 A 5/1984 Tyler
4,458,584 A 7/1984 Annese et al.
4,478,346 A * 10/1984 Spong ..... 220/711
4,487,114 A 12/1984 Abdenour
4,489,848 A 12/1984 Braudf
4,491,220 A 1/1985 Daviss
4,503,992 A 3/1985 Sitko et al.
4,518,096 A 5/1985 Winstead
4,520,716 A * 6/1985 Hayes ..... 99/306
4,564,116 A 1/1986 Prohaska
4,566,605 A 1/1986 Rogers
4,589,569 A 5/1986 Clements
D285,656 S 9/1986 Champion
4,616,762 A * 10/1986 Alexander ..... 220/658
4,619,372 A 10/1986 McFarland
4,625,890 A 12/1986 Galer
4,627,537 A 12/1986 Rogers
4,629,084 A 12/1986 Hackelsberger
D289,720 S 5/1987 Maher
D290,323 S 6/1987 Weernink
4,699,299 A 10/1987 Gach
4,717,037 A 1/1988 Van Der Meulen
4,718,788 A 1/1988 Briscoe
4,728,003 A 3/1988 Davey
4,732,274 A 3/1988 Bouton
4,735,337 A 4/1988 Von Holdt
4,738,373 A 4/1988 DeParales
D296,874 S 7/1988 Dallas
D297,799 S 9/1988 Hammer
4,782,976 A 11/1988 Kenyon
4,785,931 A 11/1988 Weir et al.
4,789,076 A 12/1988 Jewitt et al.
4,795,052 A 1/1989 Hayes, Jr.
4,807,776 A 2/1989 Cortopassi
4,823,958 A 4/1989 Mahmud
D303,194 S 9/1989 Darby et al.
4,872,569 A 10/1989 Bolte
4,872,586 A 10/1989 Landis
4,877,151 A 10/1989 Rush et al.
4,901,881 A 2/1990 McElroy
4,906,158 A 3/1990 Dewitt et al.
4,938,373 A 7/1990 McKee
4,944,102 A 7/1990 Behlendorf et al.
4,966,294 A 10/1990 Mack
4,971,211 A 11/1990 Lake
D318,427 S 7/1991 Sherburne, Jr.
5,027,972 A 7/1991 Bartholomew
5,035,320 A 7/1991 Plone
5,046,632 A 9/1991 Bordner
5,052,553 A 10/1991 Desanctis
5,054,642 A 10/1991 Yoshida
5,058,737 A 10/1991 Patterson et al.
5,060,820 A 10/1991 Boerner
5,064,082 A 11/1991 Lombardi et al.
D323,116 S 1/1992 Dart et al.
5,085,330 A 2/1992 Paulin
5,090,584 A 2/1992 Roberts et al.
D324,973 S 3/1992 Stagerman
5,099,232 A 3/1992 Howes
5,137,210 A 8/1992 Hibbs
5,145,646 A 9/1992 Tyranski
5,176,283 A 1/1993 Patterson et al.
5,180,079 A * 1/1993 Jeng ..... 220/705
D334,958 S 4/1993 Fischer
5,207,743 A 5/1993 Costarella et al.
5,234,125 A 8/1993 Roberts
5,240,136 A 8/1993 Patterson et al.
D339,027 S 9/1993 Mack
5,246,133 A 9/1993 James
5,249,700 A 10/1993 Dumke
5,283,140 A 2/1994 Netz et al.
5,292,028 A 3/1994 Patterson et al.
5,294,000 A 3/1994 Yanuzzi
5,310,072 A 5/1994 Matusovsky et al.
5,312,014 A * 5/1994 Hamlin ..... 220/703
5,318,787 A 6/1994 Brauner
5,325,982 A 7/1994 Cobb, Jr.
5,346,070 A 9/1994 McSpadden
5,346,095 A 9/1994 Deal
5,366,089 A 11/1994 Parker
5,366,104 A 11/1994 Armstrong
5,375,828 A 12/1994 Shikami
5,377,860 A 1/1995 Littlejohn et al.
5,381,901 A 1/1995 Hundley
5,385,255 A 1/1995 Varano et al.
D355,735 S 2/1995 Shaffer et al.
5,388,729 A 2/1995 Gerringer
5,390,798 A 2/1995 Yanuzzi
5,392,949 A 2/1995 McKenna
5,393,258 A 2/1995 Karterman
5,397,023 A 3/1995 Toczek et al.
5,402,903 A 4/1995 Mann
D358,294 S 5/1995 Letica
5,415,312 A 5/1995 Mueller
5,417,364 A 5/1995 Shaw
5,429,262 A 7/1995 Sharkey
5,431,276 A 7/1995 Lialin
D361,469 S 8/1995 Young
5,441,164 A 8/1995 Beck et al.
5,449,089 A 9/1995 Turner
D362,801 S 10/1995 Milroy
5,464,150 A 11/1995 Porres Sanchez et al.
5,489,026 A 2/1996 D'Aloia
5,490,609 A 2/1996 Lane et al.
5,503,858 A 4/1996 Reskow
D370,412 S 6/1996 Rohrer
5,524,788 A 6/1996 Plester
5,524,817 A 6/1996 Meier et al.
5,529,179 A 6/1996 Hanson
5,531,347 A 7/1996 Goulding
5,538,154 A 7/1996 Von Holdt
5,540,333 A 7/1996 Gonzalez et al.
5,540,349 A 7/1996 Philips
D372,866 S 8/1996 Ahern, Jr.
5,542,532 A 8/1996 Mitchell
5,573,131 A 11/1996 Berjis
5,573,133 A 11/1996 Park
D376,311 S 12/1996 Burton
5,587,192 A 12/1996 Beizermann
5,592,766 A 1/1997 Mygatt
5,593,062 A 1/1997 Martin
5,624,053 A 4/1997 Freek et al.
5,634,569 A * 6/1997 DeCoster ..... 220/735
5,641,063 A 6/1997 Gambardella et al.
5,647,499 A 7/1997 Piazza
D381,866 S 8/1997 St. Gelais
5,657,898 A 8/1997 Portman et al.
D383,944 S 9/1997 Lillelund
5,662,240 A 9/1997 Norris
5,667,094 A * 9/1997 Rapchak et al. ..... 220/834
D384,580 S 10/1997 Fernandes et al.
5,678,720 A 10/1997 Van Melle
5,685,449 A 11/1997 Oblak
5,695,052 A 12/1997 Damato
5,695,084 A 12/1997 Chmela et al.
5,697,509 A 12/1997 Hayes
5,699,927 A 12/1997 Lane et al.
5,705,210 A 1/1998 Sillince et al.
5,706,980 A * 1/1998 Dickerson ..... 222/129
5,713,463 A 2/1998 Lakoski et al.
5,720,555 A 2/1998 Elele
5,722,558 A 3/1998 Thompson
5,725,117 A 3/1998 Berjis
5,725,122 A 3/1998 Murphy et al.

(56) References Cited

U.S. PATENT DOCUMENTS 5,727,678 A 3/1998 Chen
D393,397 S 4/1998 Lillelund
5,743,423 A 4/1998 Franco
5,746,312 A 5/1998 Johnson
5,769,263 A 6/1998 Willingham et al.
5,775,570 A 7/1998 Kim
D397,911 S 9/1998 Waldmann
5,806,707 A 9/1998 Boehm et al.
5,829,583 A 11/1998 VerWeyst et al.
5,839,601 A 11/1998 Van Melle
5,875,957 A 3/1999 Yocum
5,894,952 A 4/1999 Mendenhall et al.
5,904,266 A 5/1999 Tedeschi
5,911,331 A 6/1999 Boller
5,913,964 A * 6/1999 Melton ..... 99/322
5,934,493 A 8/1999 Han
5,947,319 A 9/1999 Sinski
5,954,195 A 9/1999 Krueger et al.
5,971,195 A 10/1999 Reidinger et al.
5,979,647 A 11/1999 Han
5,984,131 A 11/1999 Krueger
5,992,061 A 11/1999 Fleck et al.
D417,845 S 12/1999 Sadlier et al.
5,996,832 A 12/1999 Nieuwoudt
6,003,671 A 12/1999 McDonough et al.
6,065,628 A 5/2000 Page
6,079,586 A 6/2000 Hanneman
6,079,587 A 6/2000 Vogt
6,085,919 A 7/2000 Singer
6,109,518 A 8/2000 Mueller et al.
6,112,891 A 9/2000 Wohl et al.
6,119,884 A 9/2000 Lowry
6,119,889 A 9/2000 Fujii et al.
6,119,930 A 9/2000 Lunstra et al.
6,164,485 A 12/2000 Hilton
6,176,390 B1 1/2001 Kemp
6,202,542 B1 3/2001 Melton
6,209,234 B1 4/2001 Meyers
6,209,748 B1 4/2001 Dunbar
6,230,969 B1 5/2001 Spransy
6,263,923 B1 7/2001 Castillo
6,264,068 B1 * 7/2001 Ours et al. ..... 222/129
6,296,141 B1 10/2001 Lukacevic
6,299,014 B1 10/2001 Nava et al.
6,311,860 B1 11/2001 Reidinger et al.
6,311,865 B1 11/2001 Laurent
6,314,866 B1 * 11/2001 Melton ..... 99/322
D453,107 S 1/2002 Wyslotsky et al.
6,338,417 B1 1/2002 Ferraro
6,354,190 B1 3/2002 Haydon
6,360,885 B1 3/2002 Krueger
6,364,102 B1 4/2002 Gordon et al.
6,375,023 B1 4/2002 Lecinski et al.
6,382,449 B1 5/2002 Kazmierski et al.
6,394,297 B1 5/2002 Nance
6,412,526 B2 7/2002 Castillo
6,425,480 B1 7/2002 Krueger et al.
6,427,864 B1 * 8/2002 Asselin ..... 220/709
6,464,099 B1 10/2002 Portman et al.
6,471,119 B2 10/2002 Cai
6,474,494 B1 * 11/2002 Miller ..... 220/379
6,488,173 B2 * 12/2002 Milan ..... 220/713
6,528,105 B1 3/2003 Gerhart et al.
D473,463 S 4/2003 Armstrong
6,557,698 B2 5/2003 Gordon
6,641,854 B2 11/2003 Gerhart
6,648,164 B1 11/2003 DeCola et al.
6,652,435 B1 11/2003 Sand
6,679,397 B2 1/2004 Smith et al.
6,706,297 B1 3/2004 Toth et al.
6,708,735 B1 3/2004 Kenihan
6,726,946 B1 4/2004 Smith
6,766,902 B1 * 7/2004 Hartelius ..... 206/217
6,793,075 B1 9/2004 Jeter
6,814,250 B1 11/2004 Madsen
6,860,397 B1 3/2005 Walters, Jr.
6,915,901 B2 7/2005 Feinberg et al.
D508,819 S 8/2005 Mangla
6,932,231 B2 8/2005 Haynes
7,063,229 B2 6/2006 Westerhof et al.
7,111,748 B2 * 9/2006 Cha ..... 220/4.27
7,159,732 B2 1/2007 Smith et al.
7,175,042 B2 2/2007 Durdon
7,182,242 B2 2/2007 Cai
7,217,434 B1 * 5/2007 Loh et al. ..... 426/115
D559,035 S 1/2008 Hayes
7,341,754 B1 * 3/2008 Loh et al. ..... 426/115
7,387,063 B2 6/2008 Vu et al.
D590,662 S 4/2009 Cheng
7,568,586 B2 8/2009 Walters, Jr.
7,588,275 B2 9/2009 Borg
7,594,584 B2 9/2009 Durdon et al.
7,699,216 B2 4/2010 Smith et al.
7,721,911 B2 5/2010 Chou
D625,139 S 10/2010 Petlak
7,832,586 B2 11/2010 Vovan
7,866,183 B2 * 1/2011 Roth et al. ..... 62/457.3
7,866,502 B2 1/2011 Maxwell
D635,855 S 4/2011 Smith et al.
D637,079 S 5/2011 Brown et al.
7,942,260 B1 5/2011 Rodriguez
D643,284 S 8/2011 Zomorodi
D643,285 S 8/2011 Zomorodi
D643,286 S 8/2011 Zomorodi
8,006,854 B2 8/2011 Waugh
8,028,847 B2 * 10/2011 Klaver et al. ..... 215/6
D648,629 S 11/2011 Zomorodi
8,109,404 B2 2/2012 Chmela
8,141,727 B2 3/2012 Gruenwald et al.
8,317,024 B1 11/2012 Persi
D672,236 S 12/2012 Zomorodi
8,381,935 B1 2/2013 Buck
8,448,801 B2 5/2013 Rusnak et al.
8,469,227 B2 * 6/2013 Tripsiznes ..... 220/719
8,485,378 B2 * 7/2013 Zoss et al. ..... 220/23.86
8,590,730 B2 11/2013 Buck
8,596,491 B2 * 12/2013 Buck ..... 220/709
8,695,819 B1 * 4/2014 Anderson ..... 215/6
8,695,845 B2 * 4/2014 Buck ..... 220/786
8,701,914 B1 4/2014 Buck
8,708,181 B2 * 4/2014 Buck ..... 220/253
8,714,393 B2 * 5/2014 Buck ..... 220/253
8,770,431 B1 * 7/2014 Glaser et al. ..... 220/521
8,783,506 B2 7/2014 Lee
8,800,801 B2 8/2014 Freeman
2001/0035417 A1 11/2001 Kantor
2002/0037378 A1 3/2002 Littlejohn et al.
2002/0125262 A1 9/2002 Canfield
2002/0148833 A1 10/2002 Simon
2003/0024930 A1 2/2003 Smith et al.
2003/0089714 A1 5/2003 Dart et al.
2003/0102312 A1 6/2003 Horner
2003/0111468 A1 6/2003 Kao
2003/0178433 A1 9/2003 Adams
2004/0035867 A1 2/2004 Schultz et al.
2004/0050724 A1 3/2004 Grul et al.
2004/0050847 A1 3/2004 Yoon
2004/0060934 A1 4/2004 Haynes et al.
2004/0084452 A1 * 5/2004 Hsieh ..... 220/256.1
2004/0089662 A1 5/2004 Smith et al.
2004/0149755 A1 8/2004 Olivar
2004/0182862 A1 9/2004 Scott
2004/0262323 A1 * 12/2004 Cha ..... 220/709
2005/0035011 A1 2/2005 McRobbie
2005/0051549 A1 * 3/2005 Nelson ..... 220/23.83
2005/0082305 A1 4/2005 Dais
2005/0103044 A1 * 5/2005 Mogil et al. ..... 62/457.7
2005/0103794 A1 5/2005 Liu
2005/0115845 A1 6/2005 Cho
2005/0178677 A1 8/2005 Morrow
2005/0178688 A1 8/2005 Hasson
2005/0199639 A1 9/2005 Tucker et al.
2005/0205437 A1 9/2005 Huffman et al.
2005/0269328 A1 12/2005 Crider et al.

(56) References Cited

U.S. PATENT DOCUMENTS

| | | | | |
|---|---|---|---|---|
| 2006/0000842 | A1 | 1/2006 | Maxwell | |
| 2006/0060589 | A1 | 3/2006 | Lee | |
| 2006/0091143 | A1 | 5/2006 | Chantalat | |
| 2006/0096983 | A1 | 5/2006 | Patterson | |
| 2006/0124648 | A1 | 6/2006 | Croft et al. | |
| 2006/0151414 | A1 | 7/2006 | Mullen | |
| 2007/0029322 | A1 | 2/2007 | Durdon et al. | |
| 2007/0068949 | A1 | 3/2007 | Crossley | |
| 2007/0181581 | A1 | 8/2007 | Ross | |
| 2007/0241105 | A1 | 10/2007 | Nielsen | |
| 2007/0278122 | A1* | 12/2007 | McCumber et al. | 206/514 |
| 2008/0023503 | A1 | 1/2008 | Freeman | |
| 2008/0078200 | A1* | 4/2008 | Roth et al. | 62/457.4 |
| 2008/0099481 | A1 | 5/2008 | D'Amato | |
| 2008/0230541 | A1 | 9/2008 | Bayss et al. | |
| 2008/0302802 | A1 | 12/2008 | Ramsden | |
| 2009/0065377 | A1 | 3/2009 | Olomi et al. | |
| 2009/0090723 | A1* | 4/2009 | Holbrook et al. | 220/521 |
| 2009/0206089 | A1 | 8/2009 | Mueller | |
| 2009/0236305 | A1 | 9/2009 | Demarco et al. | |
| 2009/0250479 | A1 | 10/2009 | Kaufman et al. | |
| 2009/0272390 | A1 | 11/2009 | Blondeel | |
| 2009/0283526 | A1 | 11/2009 | Pierce et al. | |
| 2009/0311389 | A1* | 12/2009 | Zoss et al. | 426/120 |
| 2010/0038273 | A1 | 2/2010 | Johnson | |
| 2010/0108703 | A1 | 5/2010 | French | |
| 2010/0187247 | A1 | 7/2010 | Ziegler | |
| 2010/0260901 | A1* | 10/2010 | Zoss et al. | 426/120 |
| 2010/0320213 | A1 | 12/2010 | Kelly et al. | |
| 2011/0114643 | A1* | 5/2011 | Bogdziewicz | 220/574 |
| 2011/0163102 | A1* | 7/2011 | Haynie | 220/521 |
| 2011/0168719 | A1 | 7/2011 | Lotterhos | |
| 2011/0198351 | A1 | 8/2011 | Doamato | |
| 2011/0198355 | A1 | 8/2011 | Mullen | |
| 2011/0210126 | A1* | 9/2011 | Vovan | 220/574 |
| 2011/0248033 | A1 | 10/2011 | Mehrvijeh | |
| 2011/0266295 | A1 | 11/2011 | Yacktman | |
| 2011/0272656 | A1 | 11/2011 | Attwood | |
| 2011/0284537 | A1 | 11/2011 | Cerasani | |
| 2011/0303678 | A1 | 12/2011 | Zomorodi | |
| 2011/0309093 | A1* | 12/2011 | Buck | 220/711 |
| 2012/0138608 | A1 | 6/2012 | Rusnak et al. | |
| 2012/0165170 | A1 | 6/2012 | Wischusen, III | |
| 2012/0187126 | A1 | 7/2012 | Shemesh | |
| 2012/0248116 | A1 | 10/2012 | Smyers et al. | |
| 2012/0273500 | A1 | 11/2012 | Yao | |
| 2013/0068772 | A1* | 3/2013 | Durdon et al. | 220/521 |
| 2013/0068773 | A1 | 3/2013 | Buck | |
| 2013/0068774 | A1* | 3/2013 | Buck | 220/521 |
| 2013/0092587 | A1* | 4/2013 | Postel | 206/459.1 |
| 2013/0119065 | A1 | 5/2013 | Buck | |
| 2013/0228486 | A1 | 9/2013 | BUCK | |
| 2014/0203025 | A1 | 7/2014 | Riggan et al. | |

FOREIGN PATENT DOCUMENTS

| | | | |
|---|---|---|---|
| EP | 0064047 | A1 | 4/1982 |
| EP | 0162024 | A2 | 11/1985 |
| EP | 2205309 | | 12/1988 |
| EP | 0447693 | A1 | 9/1991 |
| EP | 1397986 | | 3/2004 |
| FR | 2649080 | | 6/1989 |
| FR | 2704209 | | 10/1994 |
| GB | 1060389 | | 3/1967 |
| GB | 2322289 | | 8/1998 |
| GB | 2375531 | | 11/2002 |
| JP | 04102557 | | 4/1992 |
| RU | 2118281 | | 8/1998 |
| WO | 2006029441 | | 3/2006 |
| WO | 2009140727 | | 11/2009 |
| WO | 2012033472 | | 3/2012 |

OTHER PUBLICATIONS

Internationa Search Report and Written Opinion issued in PCT/US2013/029188 on Jul. 11, 2013.

Internationa Search Report and Written Opinion issued in PCT/US2013/070630 on Mar. 13, 2014.

Internationa Search Report and Written Opinion issued in PCT/US2013/070632 on Mar. 13, 2014.

International Preliminary Report on Patentability issued in PCT/US2012/054032 on Mar. 20, 2014.

Prodekspo 2012: TM "Zelenaya Sova" razdelnaya upakovka dlya napitkov, Feb. 16, 2012, retrieved online on Jun. 11, 2013, retrieved from the Internet http://news.unipak.ru38718comments.

* cited by examiner

CONTAINER LID WITH A FOOD COMPARTMENT AND A SIP-HOLE

1.0 TECHNICAL FIELD

The present invention relates to lids for disposable containers, and particularly to a new and novel lid with a food compartment.

2.0 RELATED APPLICATIONS

This application is related to U.S. Pat. No. 8,596,491 entitled "CUP LID WITH INTEGRATED CONTAINER" issued on Dec. 3, 2013; U.S. Pat. No. 8,695,845 entitled "TOP MOUNTING CAN CONTAINER" issued on Apr. 15, 2014; U.S. Pat. No. 8,381,935 entitled "CUP LID WITH INTEGRATED CONTAINER" issued on Feb. 26, 2013; U.S. Pat. No. 8,714,393 entitled "CUP LID WITH INTEGRATED CONTAINER" issued on May 6, 2014; U.S. Pat. No. 8,590,730 entitled "TOP MOUNTING CAN CONTAINER" issued on Nov. 26, 2013; U.S. Pat. No. 8,708,181 entitled "LID WITH INTEGRATED CONTAINER" issued on Apr. 29, 2014; U.S. Pat. No. 8,701,914 entitled "TWO-PART RECYCLABLE CUP" issued on Apr. 22, 2014; U.S. patent application Ser. No. 13/412,602 entitled "TOP MOUNTING BOTTLE CONTAINER" filed on Mar. 5, 2012; U.S. patent application Ser. No. 13/680,011 entitled "CUP LID WITH INTEGRATED CONTAINER" filed on Nov. 17, 2012; U.S. patent application Ser. No. 13/680,049 entitled "CUP LID WITH INTEGRATED CONTAINER" filed on Nov. 17, 2012; U.S. patent application Ser. No. 13/733,153 entitled "CUP LID WITH INTEGRATED CONTAINER" filed on Jan. 3, 2013; U.S. patent application Ser. No. 14/263,993 entitled "LID WITH INTEGRATED CONTAINER" filed on Apr. 28, 2014; and U.S. patent application Ser. No. 14/269,016 entitled "A CONTAINER LID WITH ONE OR MORE CAVITIES" filed on May 2, 2014 all of which are by the same inventor of the present application. Each of these applications is incorporated herein by reference.

3.0 BACKGROUND

The increased popularity of fast food establishments, coupled with the popularity for consumption of food on-the-go has led to the need for more convenient food packaging.

Billions of disposable beverage containers are used every year. Often those containers are part of a larger meal, and current technology dictates placing a lid on the beverage container, and packing the food in a separate and detached container. This may be satisfactory for a consumer seated at a table. However, when the consumer must eat on-the-go, use of the current technology is problematic. Consider, for example, a consumer that is drinking the beverage and would like to access a breakfast sandwich. The consumer must set aside a beverage, and then use one hand to hold the bag and the other hand to access the sandwich, then set aside the bag and use both hands to open the sandwich packaging. As shown in this example, current technology does not allow for convenient on-the-go eating.

To address some of these problems, yogurt manufacturers have placed a small food container on the lid of a yogurt cup. The food container (often holding nuts or granola) must be removed from the yogurt cup and then flipped over and opened, then the contents are poured into the yogurt cup. It is therefore not possible to simultaneously access the contents of the yogurt cup and the contents of the food container; rather the food container must be completely disengaged from the cup to access either contents of the yogurt cup or the contents of the food container. The food container that attaches to the yogurt cup in an upside-down position has a limited food-volume capacity because its walls taper as they proceed upward toward the bottom of the upside down container. Without this tapering, the yogurt cup/food container complex would become top-heavy and cumbersome.

What is therefore needed is a lid that overcomes these shortcomings, and fosters convenient on-the-go eating.

4.0 SUMMARY

The present invention provides an elegant solution to the needs described above and provides numerous additional benefits and advantages as will be apparent to persons of skill in the art. One aspect provides a beverage container lid with a food compartment, the lid includes an outer food container shell into which an inner food container shell is disposed. The outer food container shell has a coupling trough for attachment to the rim of a beverage container and forms a liquid-tight seal with the beverage container. The outer food container shell also includes a lower planar surface connected to the coupling trough which covers the top of the beverage container, and a beverage transfer hole extending through the planar surface. Also included in the outer food container shell is a riser wall connected to the coupling trough that defines, along with the lower planar surface, a cavity. Into the cavity is disposed the inner food container shell that has a food compartment side wall and a food compartment bottom connected to the food compartment side wall. The lid also includes a sip hole above the lower planar surface and a beverage conduit in fluid communication with the one beverage transfer hole. Thus the sip hole is in fluid communication with the contents of the beverage container.

In another aspect, the lid includes a hinge connected to a cover and to the inner food container shell. The cover may have a grip handle. The cover may also have a complementary snap-lock structure and the inner food container shell may have a snap-lock structure, wherein the snap-lock structure and the complementary snap-lock structure mate with each other when the cover is closed, thus maintaining the cover in the closed position. The cover may inhibit heat transfer into or out of the food compartment when the cover in the closed position.

For the convenience of use in grabbing food contained in the food compartment, a first portion of the food compartment side wall may generally follow a first diameter and a second portion of the food compartment side wall may generally follow a second diameter, wherein the first diameter is smaller than the second diameter. The difference in the diameters allows a user to more easily grab the food in the food compartment.

In yet another aspect, the outer food container shell may also include a coupling structure adjacent to the riser wall, and the entire outer food container shell may be monolithic. The inner food container shell may include a complementary coupling structure adjacent to the food compartment side wall, where the complementary coupling structure mates with the coupling structure and forms a liquid-tight seal. The inner food container shell may also be monolithic.

In yet another aspect, the lid may include a food compartment cover that has a cover, a hinge connected to the cover, and a hinge-snap structure. The food compartment cover may be monolithic. The hinge-snap structure of the food compartment cover is constructed to detachably mate with the complementary hinge-snap structure located on the inner food compartment shell.

Other aspects may include strengthening ribs, alignment structures, vent holes and multiple beverage access holes in various positions. The sip-hole may be part of a raised mouth piece.

The foregoing summary is illustrative only and is not meant to be exhaustive. Other aspects, objects, and advantages of this invention will be apparent to those of skill in the art upon reviewing the drawings, the disclosure, and the appended claims.

5.0 BRIEF DESCRIPTION OF THE DRAWINGS

The invention can be better understood with reference to the following figures. The components within the figures are not necessarily to scale, emphasis instead being placed on clearly illustrating example aspects of the invention. In the figures, like reference numerals designate corresponding parts throughout the different views and/or embodiments. It will be understood that certain components and details may not appear in the figures to assist in more clearly describing the invention.

6.0 DETAILED DESCRIPTION OF EXAMPLE EMBODIMENTS

Following is a non-limiting written description of example embodiments illustrating various aspects of the invention. These examples are provided to enable a person of ordinary skill in the art to practice the full scope of the invention without having to engage in an undue amount of experimentation. As will be apparent to persons skilled in the art, further modifications and adaptations can be made without departing from the spirit and scope of the invention, which is limited only by the claims.

In the following description, numerous specific details are set forth in order to provide a thorough understanding of the present invention. Particular example embodiments of the present invention may be implemented without some or all of these features or specific details. In other instances, components well known to persons of skill in the art have not been described in detail in order not to obscure unnecessarily the present invention.

Figure 1:
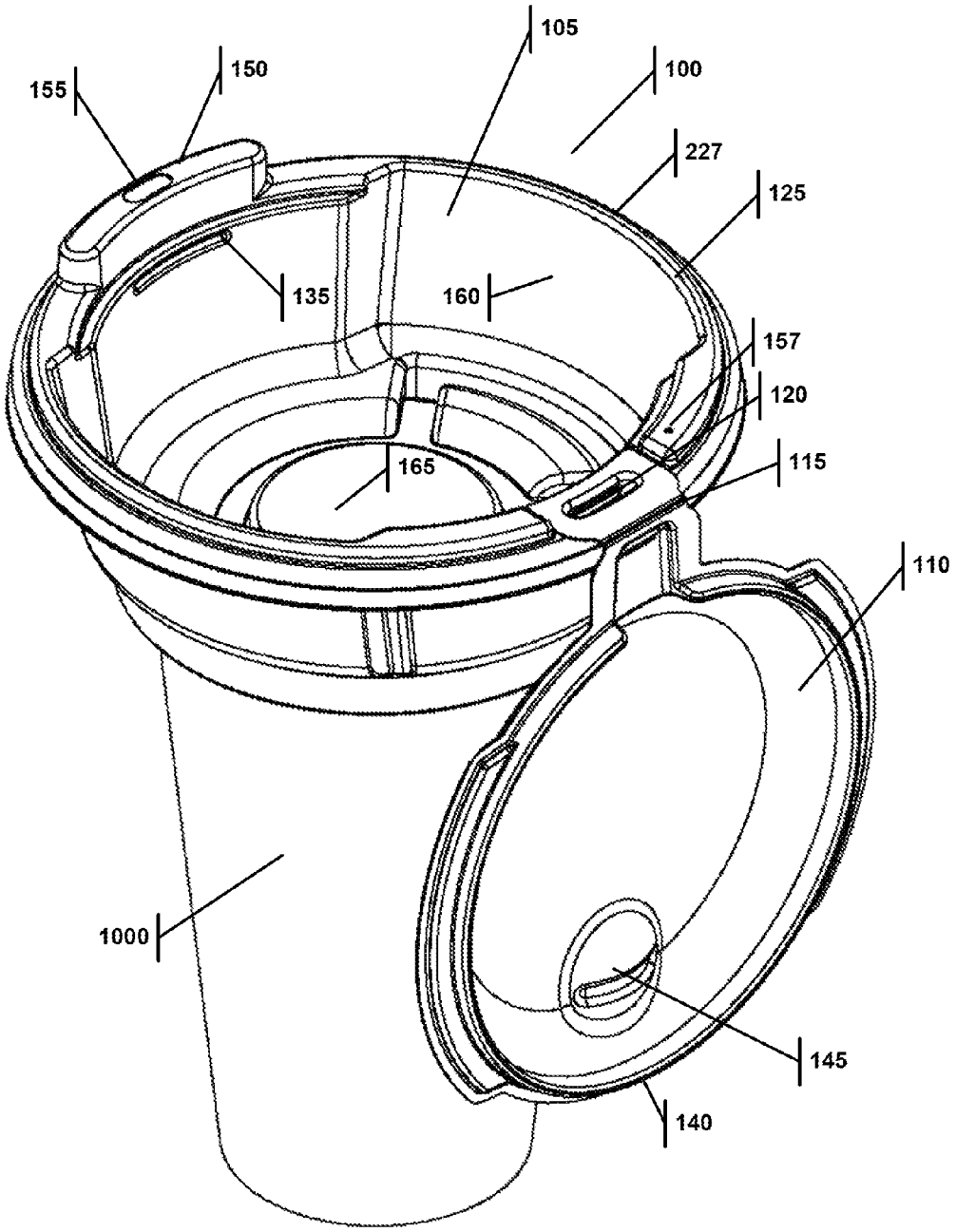
FIG. 1 is an isometric view of an embodiment of a novel lid with a food compartment attached to a beverage container, with the cover opened.

Referring to FIG. 1, a lid 100 is shown connected to a beverage container 1000. The lid 100 contains a food compartment 105 intended to hold food, such as but not limited to a breakfast sandwich. The lid 100 has a cover 110 shown in an open position, where the cover 110 is connected to a hinge 115, that then connects to a hinge-snap structure 120; thus allowing the hinge 115 to connect to the inner food container 125. Located on the inner food container 125 is a complementary hinge-snap structure 130 (see FIG. 4) that mates with the hinge-snap structure 120 and detachably fixes the cover 110 to the inner food container shell 125. This mating is assisted by the plastic deformability of the materials used.

Figure 3:
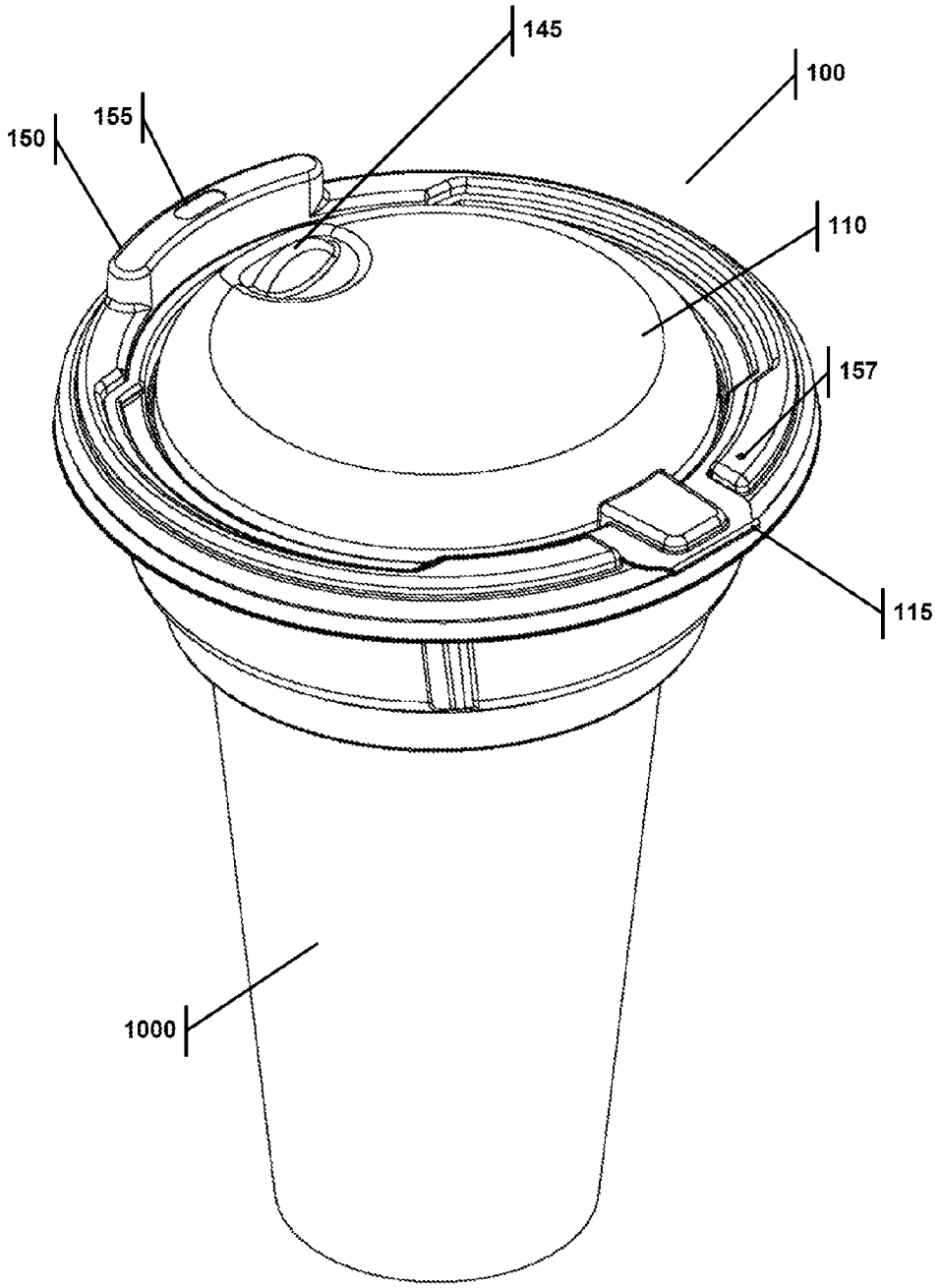
FIG. 3 illustrates the embodiment of FIG. 1, in an isometric view with a beverage container, with the cover closed.

The inner food container shell 125 also has a snap-lock structure 135 (illustrated as a groove) and the cover 110 has a complementary snap-lock structure 140 (illustrated as a tongue). When the cover 110 is closed (shown in FIG. 3), the complementary snap-lock structure 140 mates with the snap-lock structure 135 and maintains the cover 110 in the closed position. This mating is also assisted by the plastic deformability of the materials used. Specifically, as the cover 110 is closed, the complementary snap-lock structure 140 (i.e., the tongue) flexes as does the snap-lock structure 135 (i.e., the grove), until the tongue snaps into the groove. The lid 100 is shown in the closed position in FIG. 3. To re-open the cover 110, the complementary snap-lock structure 140 (i.e., the tongue) and the snap-lock structure 135 (i.e., the grove) must again flex. A user may use the coin-shaped grip handle 145 to lift the cover 110 and thus remove the tongue from the groove.

The inner food container shell 125 also has a raised mouth piece 150 with a sip hole 155. The raised mouth piece 150 is configured as a narrow structure that fits comfortably between the lips of the user. The sip hole 155 is in fluid connection with the beverage contained in the beverage container 1000. This is discussed in further detail below with reference to FIGS. 7A and 7B. When a user sips a beverage through the sip hole 155, the lid 100 may experience negative pressure which may be relieved by vent hole 157.

Figure 2A:
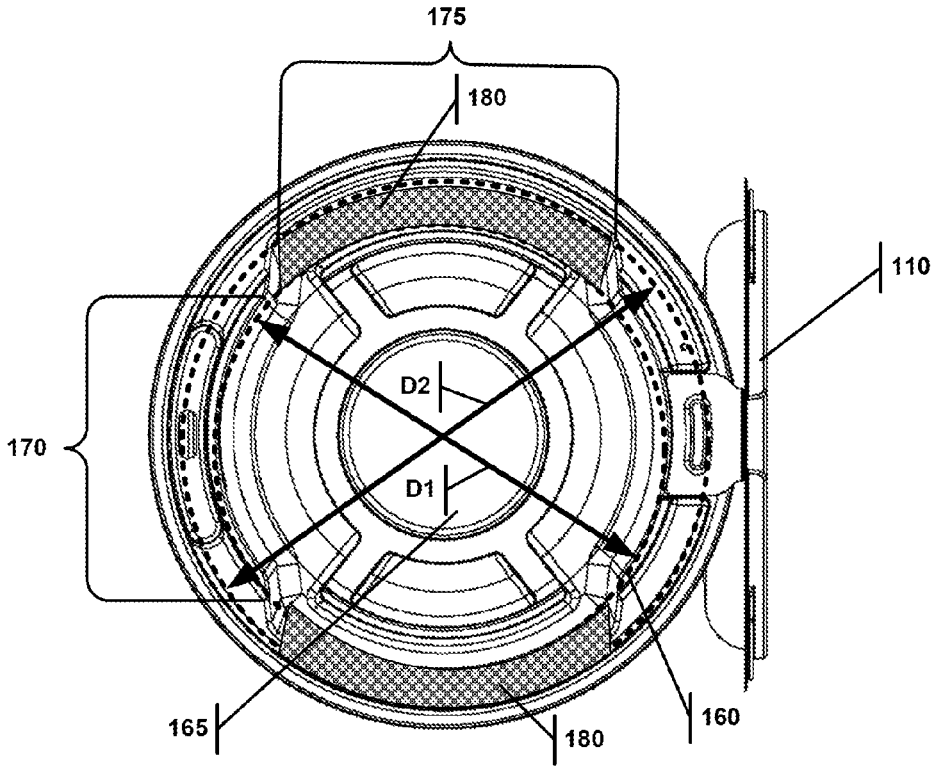
FIG. 2A illustrates the embodiment of FIG. 1, in a top plan view with the cover opened.
Figure 2B:
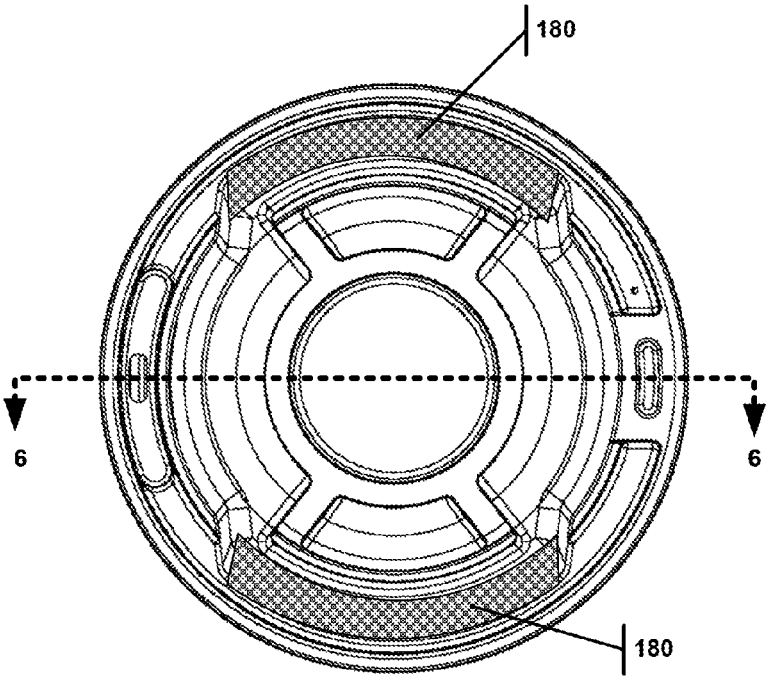
FIG. 2B illustrates the embodiment of FIG. 1, in a top plan view with the cover removed.

The food compartment 105 is surrounded by a food compartment side wall 160 (that descends from the upper edge surface 227 of the inner food container shell 125) and has a food compartment bottom 165. Preferably, the food compartment side wall (or walls) 160 does not follow a constant diameter. FIGS. 2A and 2B illustrate a top plan view of the lid 100, with the cover 110 attached and open (FIG. 2A) and without a cover (FIG. 2B). The food compartment 105 has a food compartment side wall 160 and a food compartment bottom 165. But this figure illustrates that the food compartment side wall 160 does not follow a single diameter, where the diameter is defined from a central point located in the center of the food compartment 105. Rather a first portion 170 of the food compartment side wall follows a diameter D1, while a second portion 175 follows a diameter D2. The diameter D1 is smaller than D2, which pushes the second portion 175 of the food compartment side wall closer to the outer edge of the inner food container shell 125. The area shown in shaded area 180 is known as the finger grab area, and allows a user to more easily lift the food out of the food compartment 105. For example, if a breakfast sandwich with a circular bun is placed in the food compartment 105 it will have a diameter less that D1 and therefore will not occupy the finger grab area 180. A user can then reach into the finger grab area 180 and effectively grab the sandwich without obstruction from the food compartment side wall 160.

Figure 4:
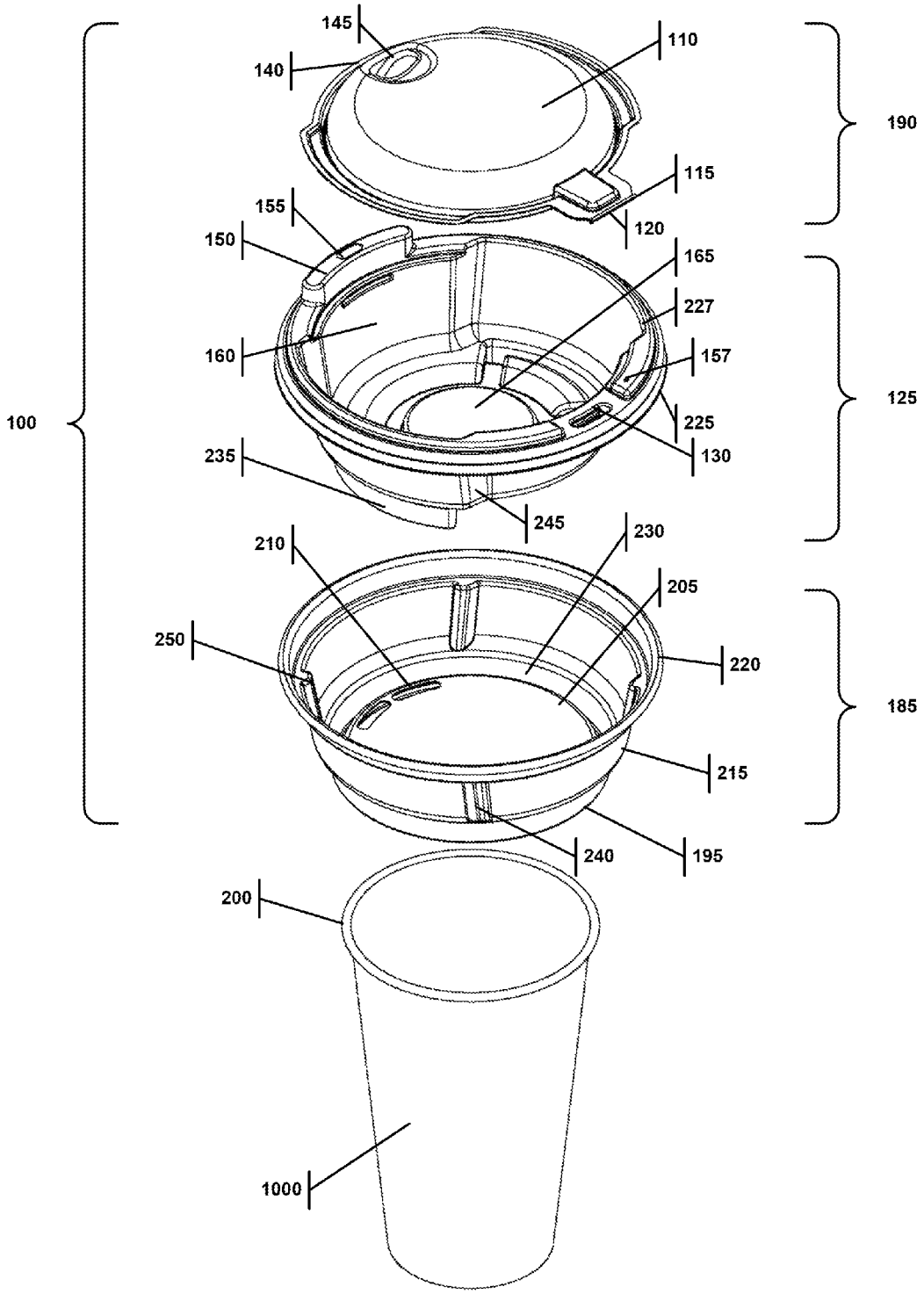
FIG. 4 illustrates the embodiment of FIG. 1, in an exploded and top isometric view with a beverage container.

Turning to FIG. 4, an exploded view of a three piece embodiment is shown. The lid 100 is comprised of three pieces: outer food container shell 185, the inner food container shell 125 and the food compartment cover 190. The outer food container shell 185 is the piece that contacts the beverage container 1000, by way of a coupling trough 195 that mates with the rim 200 (shown in greater detail in FIG. 6). Given the flexing ability of the materials used, the coupling trough 195 and the rim 200 snap together and form a liquid-tight seal.

A lower planar surface 205 is connected to the coupling trough 195 and covers the top of the beverage container 1000. Throughout this disclosure the terms "above" and "below" will be used, and are intended to mean the following: "above" is a location that is vertically higher when the lid 100 is attached to a beverage container 1000 resting on a horizontal surface; and "below" is a location that is vertically lower when the lid 100 is attached to a beverage container 1000 resting on a horizontal surface. Likewise, "lower," "raised" and "upper" are defined by the same reference frame.

Within the lower planar surface 205 is a beverage transfer hole (or holes) 210, that allows the beverage contained in the beverage container 1000 to flow into the outer food container shell 185. A riser wall (or walls) 215 rise away from the coupling trough in a generally vertical direction. At the top of the riser wall 215 is a coupling structure 220 (shown as a ring) that mates with a complementary coupling structure 225, thus detachably fixing the outer food container shell 185 to the inner food container shell 125. Because of the flexibility of the materials used, the coupling structure 220 and the complementary coupling structure 225 snap together and form a liquid-tight seal. The top of the riser wall 215, which is coupling structure 220 and the complementary coupling structure 225, defines an upper edge surface 227. It is from this surface 227 that the food compartment side wall 160 descends and forms the food compartment 105.

It should been noted that the riser wall 215 is not completely vertical; rather it flares out and may accomplish the flaring either gradually or in steps. The embodiment shown in FIG. 4 uses both a gradual flare and a step flare. The result of this flaring is that the top diameter of the outer food container shell 185 is larger than the rim 200 of the beverage container 1000. This then accommodates a larger diameter inner food compartment shell 125 with a food compartment 105 having a larger volume. Stated another way, the coupling trough 200 circumscribes a footprint. What is meant by a footprint is essentially the area the coupling trough 200 would project onto a horizontal surface when the lid 100 is placed on a horizontal surface. The riser wall 215 would therefore extend out of this footprint because of the flaring.

Located within the outer food container shell 185, and adjacent to the coupling trough 195 is a beverage overflow channel 230. This channel 230 is formed in part by the coupling trough 200 (shown in more detail in FIG. 6). As a user tilts the beverage container 1000/lid 100 complex, the beverage travels through the at least one beverage transfer hole 210, while on its way to the sip hole 155. When the user places the beverage container 1000/lid 100 complex down, the majority of the beverage held in the outer food compartment shell 185 will drain back into the beverage container 1000. Some beverage, however will pool in the beverage overflow channel 230. To address this pooling, the inner food compartment shell 125 may have a jutting structure 235 that is complementary to a portion of the beverage overflow channel 230. When the inner food compartment shell 125 is attached to the outer food compartment shell 185, the jutting structure 235 displaces a portion of the volume of the beverage overflow channel 230, thereby reducing the amount of pooling.

The outer food container shell 185 may also have a strengthening rib 240, that may perform two functions: first, it strengthens the overall lid 100 structure and second, the rib 240 can act as an alignment structure that restricts the position of the outer food container shell 185 relative to the inner food container shell 125. Specifically, the food compartment side wall 160 follows a larger diameter (see FIG. 2, second portion 175), that results in a side wall that juts out at position 245. The portion of the food compartment side wall that follows a larger diameter (i.e., FIG. 2 second portion 175) is adapted to fit into the space flanked by strengthening ribs 240 and 250.

Figure 5:
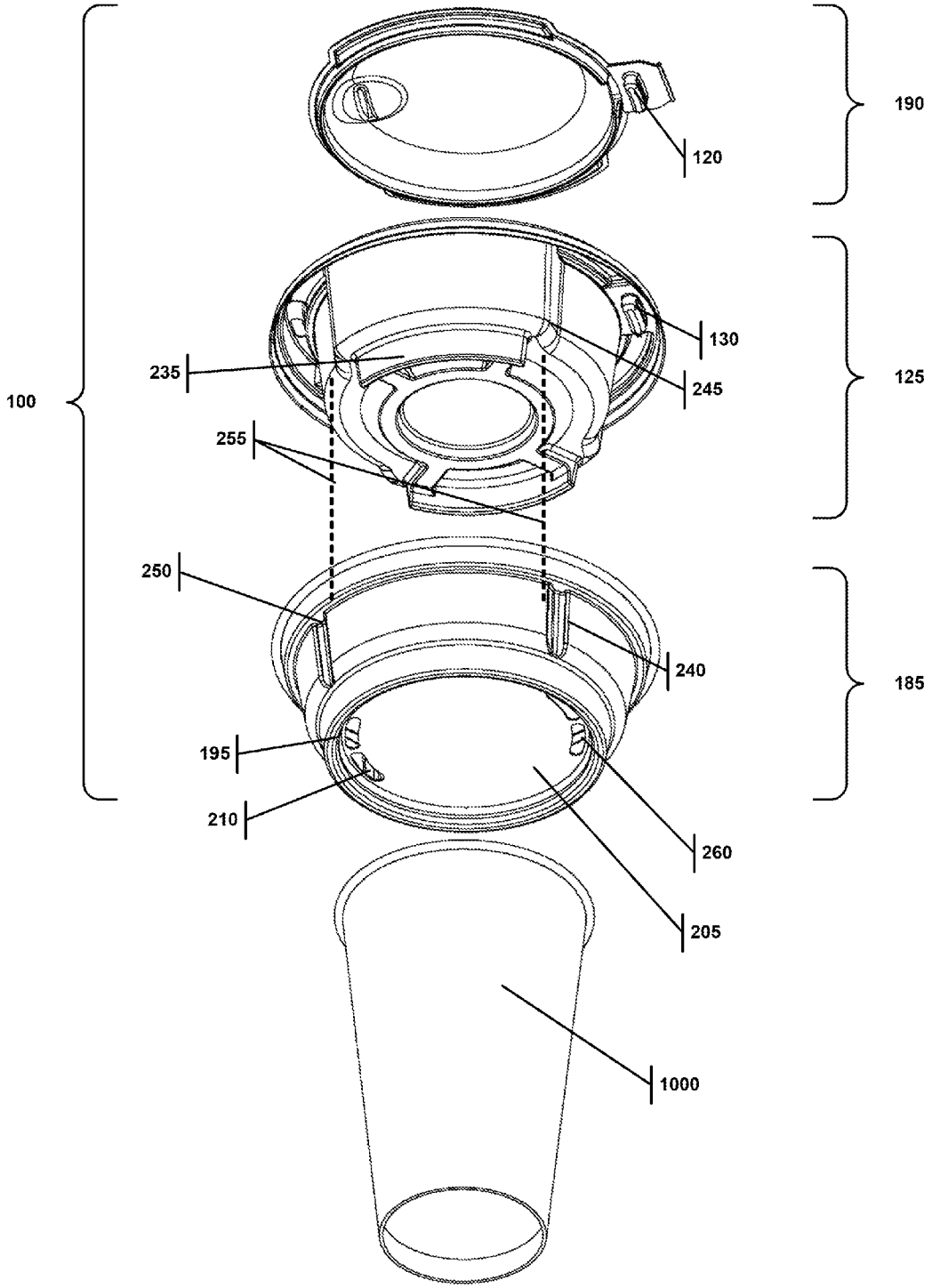
FIG. 5 illustrates the embodiment of FIG. 1, in an exploded and bottom isometric view with a beverage container.

FIG. 5 more clearly illustrates the jutting structure 235 of the inner food compartment shell 125. FIG. 5 also shows how the strengthening ribs 240, 250 can restrict the position of the outer food container shell 185 relative to the inner food container shell 125. Dashed lines 255 illustrate where the side wall jut position 245 would fit into the portion of the outer food compartment shell 185 flanked by the strengthening ribs 240, 250.

The view angle of FIG. 5 also more clearly shows that the at least one beverage transfer hole (or holes) 210 are located along the outer edge of lower planar surface 205, adjacent to the coupling trough 195. Moreover, there may be an additional beverage transfer hole 260 (or holes) on the opposite edge of the lower planar surface 205. Multiple beverage transfer holes assist in draining the beverage back into the beverage container 1000 when the user holds the beverage container 1000/lid 100 complex in a horizontal position or places the beverage container 1000/lid 100 complex on a horizontal surface such as a table top.

Figure 6:
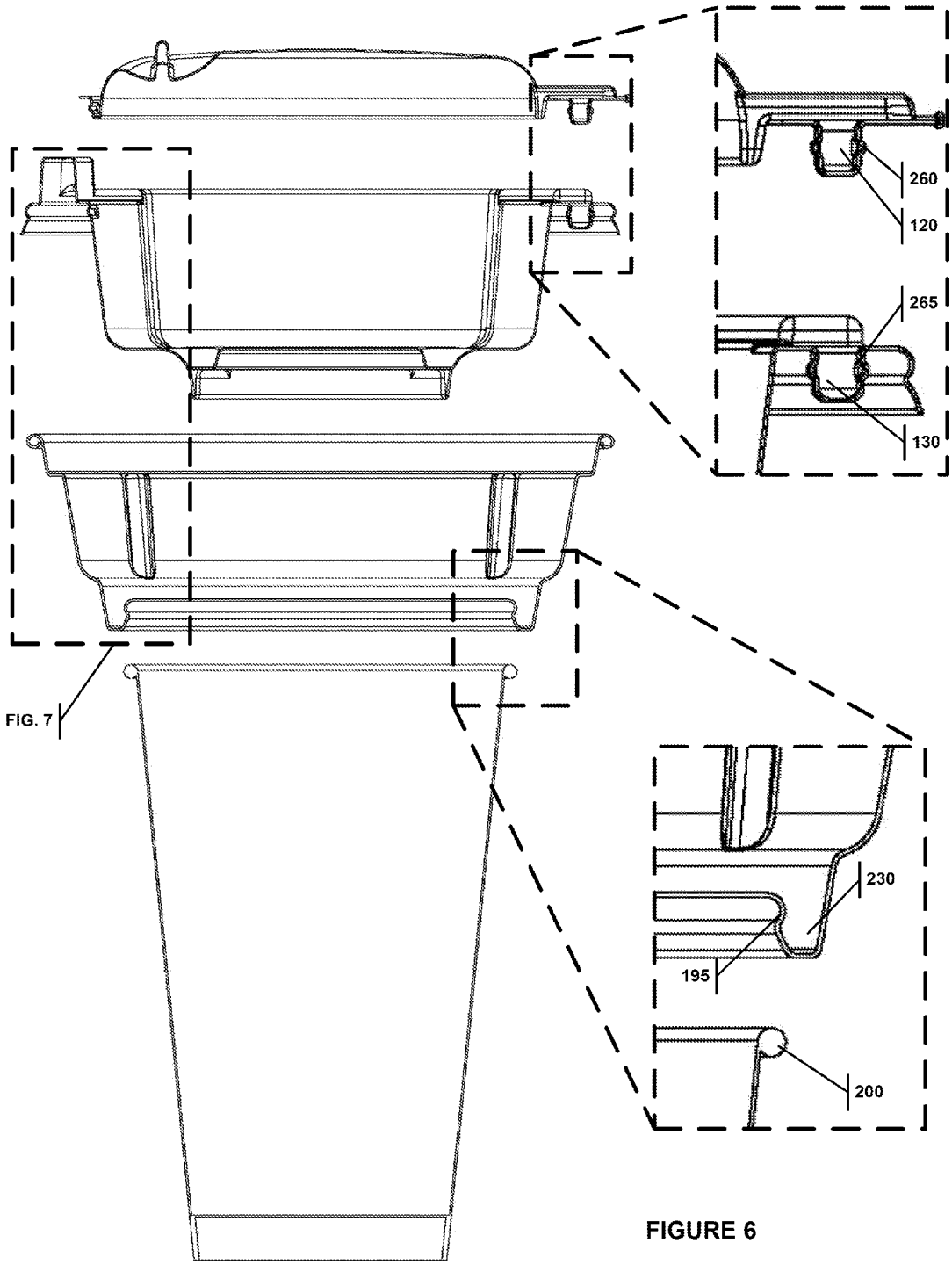
FIG. 6 illustrates the embodiment of FIG. 1, in an exploded and cross-sectional view taken along line 6-6 of FIG. 2B.

FIG. 6 is a cross-sectional view of the lid 100 cut along the line 6-6 of FIG. 2B. An enlarged view of the coupling trough 195 is shown, along with the beverage container 1000, rim 200 and the beverage overflow channel 230. The coupling trough 195 has a circular portion that complements the shape of the rim 200, and allows the rim 200 to snap in, forming a liquid-tight seal. This is the same type of mating structure used for the coupling structure 220 and the complementary coupling structure 225 used to attached the inner food container shell 125 to the outer food container shell 185.

FIG. 6 also provides an enlarged view of the hinge-snap 120 and the complementary hinge-snap structure 130. The hinge-snap 120 may have small protrusions 260 and fit into a complementary indent 265 on the complementary hinge-snap structure 130. Once the hinge-snap 130 is inserted into the complementary hinge-snap structure 130, the protrusion 260 fill the complementary indent 265, detachably fixing the food compartment cover 190 to the inner food compartment shell 120.

Figure 7A:
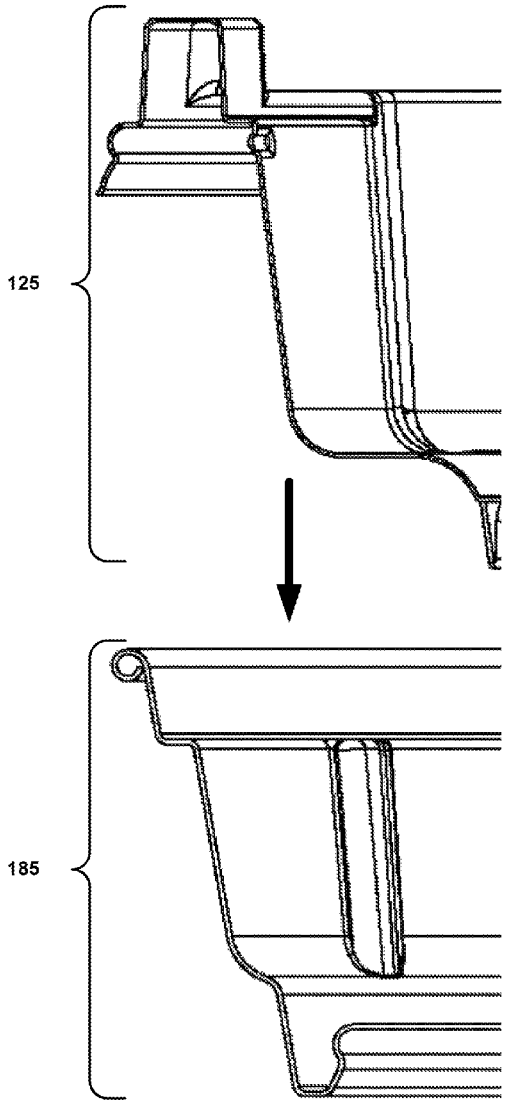
FIG. 7A illustrates a portion the embodiment of FIG. 1, in an exploded and cross-sectional view taken along line 6-6 of FIG. 2B.
Figure 7B:
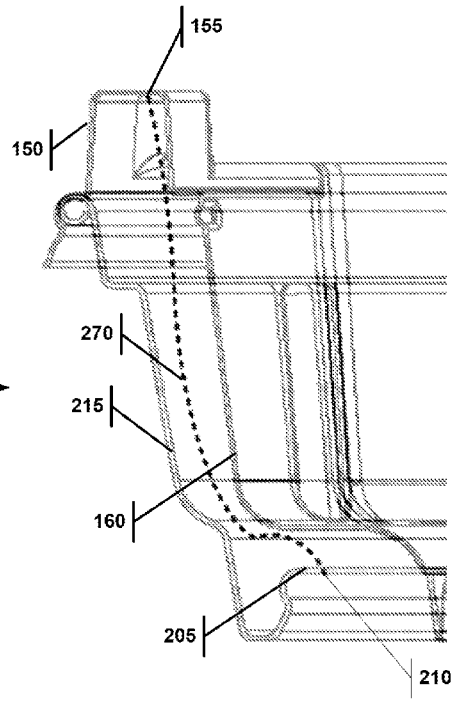
FIG. 7B illustrates the embodiment of FIG. 1, in a cross-sectional view to show the beverage conduit.

FIG. 7A is a cross-sectional view of a portion of the lid 100 cut along the line 6-6 of FIG. 2B. When the inner food container shell 125 is lowered into the outer food container shell 185 and snapped into place, a beverage conduit 270 is formed as show in FIG. 7B. Specifically, the beverage conduit 270 connects the sip hole 155 to the at least one beverage transfer hole 210. The beverage conduit 270 is formed by the riser wall 215 of the outer food compartment shell 185, and the food compartment side wall 160 of the inner food compartment shell 125.

When the inner and outer food container shells 125, 185 are snapped together and coupled to the rim 200 of the beverage container 1000, and the beverage container 1000 is tilted toward the user's mouth, the beverage in the beverage container 1000 flows through the at least one beverage transfer hole 210 that is cut through the lower planar surface 205.

After passing through the at least one beverage transfer hole 210, the beverage continues through the beverage conduit 270 formed by the riser wall 215 and the food compartment side wall 160, and passes through the sip hole 155 that is centered in the top horizontal wall of the raised mouth piece 150.

Figure 8A:
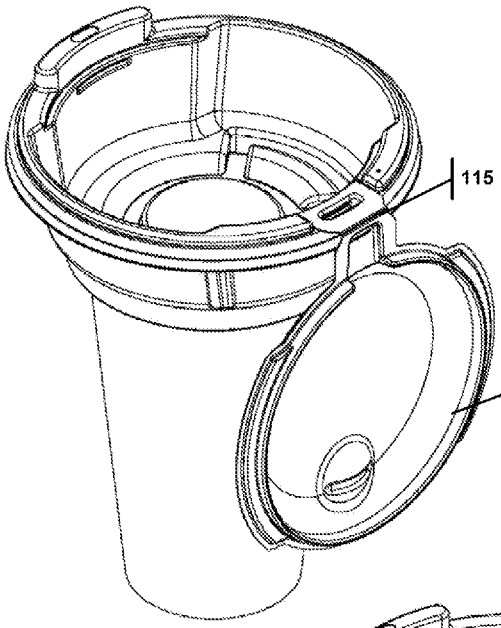
FIG. 8A illustrates the embodiment of FIG. 1, in an isometric view with a beverage container, with the cover opened.
Figure 8B:
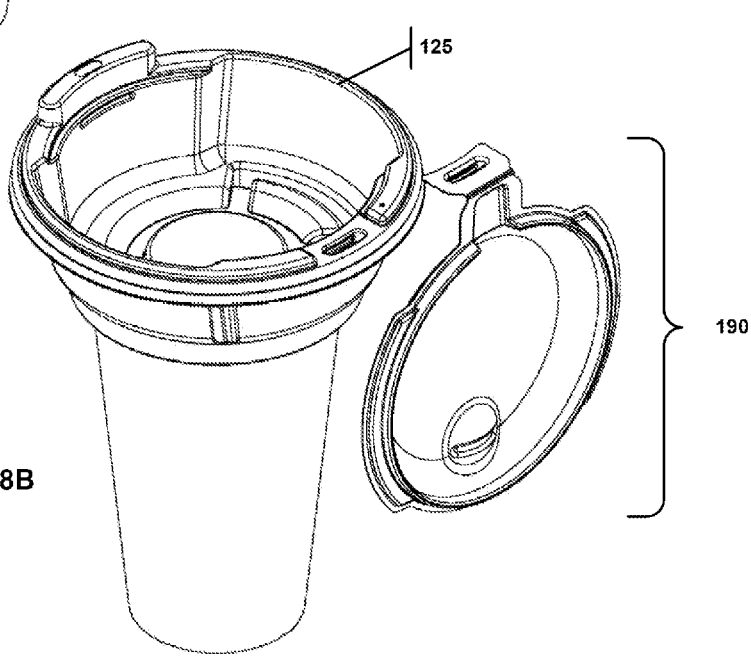
FIG. 8B illustrates the embodiment of FIG. 1, in an isometric view with a beverage container, with the cover opened and detached.
Figure 9A:
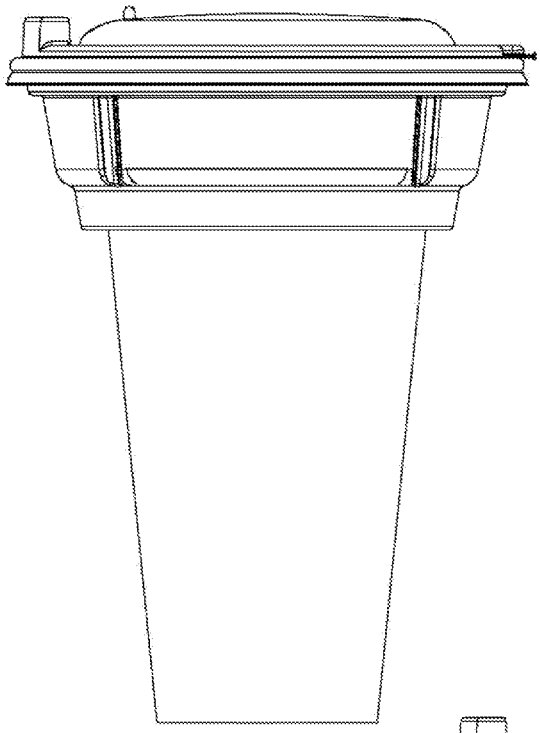
FIG. 9A illustrates the embodiment of FIG. 1, in a side view with a beverage container, with the cover closed.
Figure 9B:
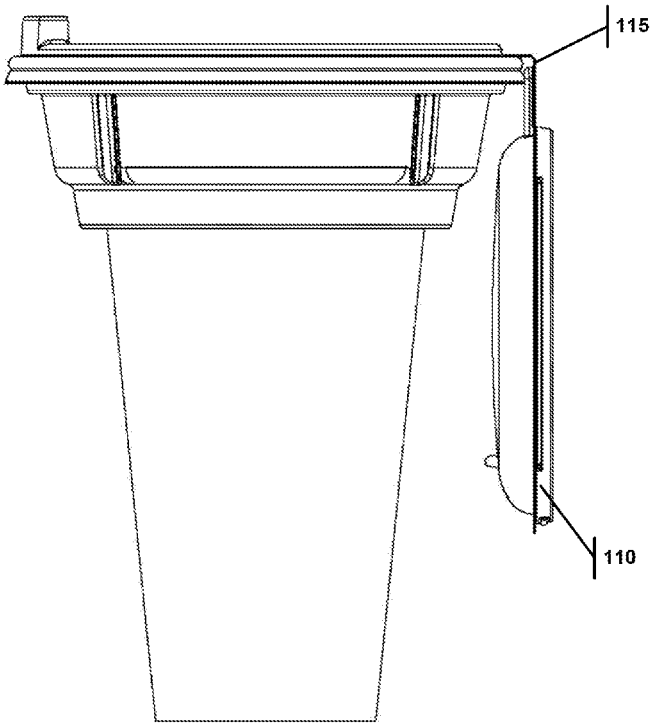
FIG. 9B illustrates the embodiment of FIG. 1, in a side view with a beverage container, with the cover opened.

FIG. 8A illustrates the range of motion of the hinge 115. Because the hinge 115 is placed on the outer edge of the lid 100, the cover 110 can be fully opened and out of the way of a user attempting to sip the beverage. This is also shown in FIG. 9B. The food compartment cover 190 can be completely detached from the inner food compartment shell 125, as shown in FIG. 8B. The cover 110 is shown in the closed position in FIG. 9A.

The outer food container shell 185, the inner food container shell 125 and the food compartment cover 190 can be manufactured using a variety of conventional techniques, including but not limited to thermoform. Thermoforming is a manufacturing process where a plastic sheet is heated to a pliable forming temperature, formed to a specific shape in a mold, and trimmed to create a usable product. The sheet is heated in an oven to a high-enough temperature that it can be stretched into or onto a mold and cooled to a finished shape. Thermoforming is a reliable and inexpensive technique that is used for conventional beverage container lids.

The unique three-piece lid described above creates a three-dimensional shape when the pieces are combined that would be impossible to manufacture using thermoforming to make a single piece. But by having separate pieces that mate precisely with each other, the complicated three-dimensional shape is possible including, for example, the beverage conduit 270 that is formed which allows a user to access the beverage contained in the beverage container 1000.

Each of the three pieces—i.e., outer food container shell 185, the inner food container shell 125 and the food compartment cover 190—are monolithic, meaning that they are created by a single and uniform sheet of plastic. This also allows these pieces to be made from different materials. For example, the outer food container shell 185 may be an opaque black so as to visually mask the flow of the beverage (like coffee) along the inside of the riser wall 215. The inner food container shell 125 may be an opaque white which provides a more visually appealing presentation of the food within the food compartment 105. And the food compartment cover 190 may be constructed of transparent plastic, allowing the user to visually verify that the food contained in the food compartment 105 is indeed what was ordered.

The types of material would be apparent to one of skill in the art and may include by non-limiting example PP (polypropylene), PET (polyethylene terephthalate), CPET, RPET Polyethylene (HDPE/LDPE), styrene, HIPS, HMWPE, PP/PE blends, custom blends of thermoplastics (which may or may not include post-consumer or post-industrial content) and other proprietary blends of thermoplastics.

The invention has been described in connection with specific embodiments that illustrate examples of the invention but do not limit its scope. Various example systems have been shown and described having various aspects and elements. Unless indicated otherwise, any feature, aspect or element of any of these systems may be removed from, added to, combined with or modified by any other feature, aspect or element of any of the systems. As will be apparent to persons skilled in the art, modifications and adaptations to the above-described systems and methods can be made without departing from the spirit and scope of the invention, which is defined only by the following claims. Moreover, the applicant expressly does not intend that the following claims "and the embodiments in the specification to be strictly coextensive." *Phillips* v. *AHW Corp*., 415 F.3d 1303, 1323 (Fed. Cir. 2005) (en banc).

The invention claimed is:

1. A beverage container lid with a food compartment comprising:

an outer food container shell comprising:

a coupling trough for attachment to the rim of a beverage container and adapted to form a liquid-tight seal with the beverage container;

a lower planar surface connected to the coupling trough and adapted to cover the top of the beverage container;

at least one beverage transfer hole extending through the planar surface;

a riser wall connected to the coupling trough, the riser wall extending away from the coupling trough, and wherein the riser wall defines an upper edge surface above the lower planar surface, and wherein the riser wall and the lower planar surface define a cavity;

a coupling structure at a top of the riser wall;

an inner food container shell disposed in the cavity, the inner food container shell comprising:

a food compartment side wall extending from the upper edge surface to a position lower than the upper edge surface; and a food compartment bottom connected to the food compartment side wall;

wherein the food compartment side wall and food compartment bottom define a food compartment;

a complementary coupling structure at a top of the food compartment side wall, the complementary coupling structure comprising an overhang with an outer edge and a skirt descending from the outer edge of the overhang, wherein the complementary coupling structure is constructed to detachably mate with the coupling structure such that the overhang and skirt contact the coupling structure forming a liquid-tight seal;

a sip hole above the lower planar surface;

a beverage conduit in fluid communication with the at least one beverage transfer hole and the sip hole, wherein the sip hole is in fluid communication with the contents of the beverage container; and a cover that is detachably fixed to the inner food container shell, the cover and the food compartment side wall constructed to prevent fluid communication between the food compartment and the beverage conduit.

2. The beverage container lid of claim 1, wherein the coupling trough circumscribes a footprint and the riser wall extends outside of that footprint.

3. The beverage container lid of claim 1, wherein the riser wall further comprises at least one strengthening rib.

4. The beverage container lid of claim 1, wherein the at least one beverage transfer hole is adjacent to the coupling trough.

5. The beverage container lid of claim 1, wherein the at least one beverage transfer hole further comprises at least two beverage transfer holes and the beverage transfer holes are on opposite ends of the planar surface from each other and each beverage transfer hole is adjacent to the coupling trough.

6. The beverage container lid of claim 1, wherein the beverage conduit further comprises a beverage overflow channel adjacent to the coupling trough; and wherein the food compartment bottom further comprises a jutting structure that juts into a portion of the beverage overflow channel, displacing a portion of the volume of the beverage overflow channel.

7. The beverage container lid of claim 1, wherein the sip hole further comprises a raised mouth piece.

8. The beverage container lid of claim 1, further comprising a vent hole.

9. The beverage container lid of claim 1, the lid further comprising:

a hinge connected to the cover and to the inner food container shell.

10. The beverage container lid of claim 9, wherein the cover further comprises a grip handle.

11. The beverage container lid of claim 9, wherein the cover further comprises a complementary snap-lock structure and the outer food container shell further comprises a snap-lock structure, wherein the snap-lock structure and the complementary snap-lock structure mate with each other when the food compartment cover is closed.

12. The beverage container lid of claim 9, wherein the cover is constructed to inhibit heat transfer into or out of the food compartment, when the cover is in the closed position.

13. The beverage container lid of claim 1, wherein a first portion of the food compartment side wall generally follows a first diameter and a second portion of the food compartment side wall generally follows a second diameter, wherein the first diameter is smaller than the second diameter.

14. The beverage container lid of claim 1, wherein the beverage conduit is formed by the riser wall and the food compartment side wall when the outer food container shell is detachably connected to the inner food container shell.

15. The beverage container lid of claim 1, wherein the inner food container shell further comprises a complementary hinge-snap structure, the lid further comprising:

a food compartment cover comprising:

a cover;

a hinge connected to the cover; and a hinge-snap structure, wherein the food compartment cover is monolithic; and wherein the hinge-snap structure is constructed to detachably mate with the complementary hinge-snap structure.

16. The beverage container lid of claim 15, wherein the cover further comprises a grip handle.

17. The beverage container lid of claim 15, wherein the cover further comprises a complementary snap-lock structure and the upper food container shell further comprises a snap-lock structure, wherein the snap-lock structure and the complementary snap-lock structure mate with each other when the cover is closed.

18. The beverage container lid of claim 15, wherein the food compartment cover is constructed to inhibit heat transfer into or out of the food compartment, when the cover is in the closed position.

* * * * *